US008659513B2

(12) United States Patent
Choi et al.

(10) Patent No.: US 8,659,513 B2
(45) Date of Patent: Feb. 25, 2014

(54) PIXEL AND ORGANIC LIGHT EMITTING DISPLAY DEVICE USING THE SAME

(75) Inventors: Sang-Moo Choi, Yongin (KR); Chul-Kyu Kang, Yongin (KR); Keum-Nam Kim, Yongin (KR)

(73) Assignee: Samsung Display Co., Ltd., Yongin-si (KR)

( * ) Notice: Subject to any disclaimer, the term of this patent is extended or adjusted under 35 U.S.C. 154(b) by 667 days.

(21) Appl. No.: 12/883,025

(22) Filed: Sep. 15, 2010

(65) Prior Publication Data

US 2011/0157143 A1 Jun. 30, 2011

(30) Foreign Application Priority Data

Dec. 31, 2009 (KR) ..... 10-2009-0135196

(51) Int. Cl.
*G09G 3/30* (2006.01)

(52) U.S. Cl.
USPC ..... 345/76; 345/82; 345/212; 345/690

(58) Field of Classification Search
USPC ..... 345/711, 712, 76, 82, 690, 89, 211, 212
See application file for complete search history.

(56) References Cited

U.S. PATENT DOCUMENTS

| | | | | |
|---|---|---|---|---|
| 2006/0170628 | A1* | 8/2006 | Yamashita et al. | 345/76 |
| 2008/0211397 | A1* | 9/2008 | Choi | 313/504 |
| 2008/0291125 | A1* | 11/2008 | Yamashita et al. | 345/55 |
| 2009/0244050 | A1* | 10/2009 | Yamamoto et al. | 345/212 |

FOREIGN PATENT DOCUMENTS

| | | | |
|---|---|---|---|
| KR | 1020030079656 | A | 10/2003 |
| KR | 10-2006-0104841 | | 10/2006 |
| KR | 2008-026467 | | 2/2008 |
| KR | 1020080025591 | A | 3/2008 |
| KR | 1020090046053 | A | 5/2009 |
| KR | 100947992 | B1 | 3/2010 |

OTHER PUBLICATIONS

KIPO Office action dated Jul. 28, 2011, for Korean priority Patent application No. 10-2009-0135196, noting reference(s) cited herein, 1 page.

* cited by examiner

*Primary Examiner* — Amare Mengistu
*Assistant Examiner* — Gloryvid Figueroa-Gibson
(74) *Attorney, Agent, or Firm* — Christie, Parker & Hale, LLP

(57) ABSTRACT

A pixel capable of displaying images with substantially uniform luminance and an organic light emitting display device using the same are provided. An organic light emitting display device is driven in a frame divided into a reset period, a compensation period and an emission period. The organic light emitting display device includes pixels coupled to scan lines and data lines. First and second control lines are commonly coupled to the pixels. A control line driver supplies first and second control signals to the respective first and second control lines. A scan driver concurrently supplies a scan signal to the scan lines during a time in the reset and compensation periods. A data driver supplies a reset voltage to the data lines during the time in the reset and compensation periods.

22 Claims, 13 Drawing Sheets

PIXEL AND ORGANIC LIGHT EMITTING DISPLAY DEVICE USING THE SAME

CROSS-REFERENCE TO RELATED APPLICATION

This application claims priority to and the benefit of Korean Patent Application No. 10-2009-0135196, filed on Dec. 31, 2009, in the Korean Intellectual Property Office, the entire content of which is incorporated herein by reference.

BACKGROUND

1. Field

Aspects of embodiments according to the present invention relate to a pixel and an organic light emitting display device using the same.

2. Description of Related Art

Flat panel display devices include liquid crystal display devices, field emission display devices, plasma display panels, organic light emitting display devices, and the like. Among these flat panel display devices, the organic light emitting display devices display images using organic light emitting diodes that emit light through a recombination of electrons and holes. Organic light emitting display devices have a fast response speed and low power consumption.

FIG. 1 is a circuit diagram of a related art pixel of an organic light emitting display device. In FIG. 1, transistors included in the pixel are NMOS transistors.

Referring to FIG. 1, the pixel 4 of the organic light emitting display device includes an organic light emitting diode OLED, and a pixel circuit 2 coupled to a data line Dm and a scan line Sn for controlling the organic light emitting diode OLED.

An anode electrode of the organic light emitting diode OLED is coupled to the pixel circuit 2, and a cathode electrode of the organic light emitting diode OLED is coupled to a second power source ELVSS. The organic light emitting diode OLED generates light with a luminance (e.g., a predetermined luminance) corresponding to current supplied from the pixel circuit 2.

When a scan signal is supplied to the scan signal line Sn, the pixel circuit 2 controls the amount of current supplied to the organic light emitting diode OLED according to a data signal supplied to the data line Dm. To this end, the pixel circuit 2 includes a second transistor M2' (e.g., drive transistor) coupled between a first power source ELVDD and the organic light emitting display device; a first transistor M1' coupled between the second transistor M2' and the data and scan lines Dm and Sn; and a storage capacitor Cst coupled between a gate electrode and a second electrode of the second transistor M2'.

A gate electrode of the first transistor M1' is coupled to the scan line Sn, and a first electrode of the first transistor M1' is coupled to the data line Dm. A second electrode of the first transistor M1' is coupled to one terminal of the storage capacitor Cst. Here, the first electrode may be either a source or drain electrode, and the second electrode may be the other of the source or drain electrode. For example, when the first electrode is set as a drain electrode, the second electrode is set as a source electrode. When a scan signal is supplied from the scan line, the first transistor M1', coupled to the scan and data lines Sn and Dm, is turned on to supply a data signal supplied from the data line Dm to the storage capacitor Cst. At this time, a voltage corresponding to the voltage of the data signal is charged (e.g., stored) into the storage capacitor Cst.

The gate electrode of the second transistor M2' is coupled to the one terminal of the storage capacitor Cst, and a first electrode of the second transistor M2' is coupled to the first power source ELVDD. A second electrode of the second transistor M2' is coupled to the other terminal of the storage capacitor Cst and the anode electrode of the organic light emitting diode OLED. The second transistor M2' controls the amount of current that flows from the first power source ELVDD to the second power source ELVSS via the organic light emitting diode OLED, corresponding to the voltage stored in the storage capacitor Cst.

The one terminal of the storage capacitor Cst is coupled to the gate electrode of the second transistor M2', and the other terminal of the storage capacitor Cst is coupled to the anode electrode of the organic light emitting diode OLED. The voltage corresponding to the voltage of the data signal is charged in the storage capacitor Cst.

In the pixel 4, the current corresponding to the voltage charged into the storage capacitor Cst is supplied to the organic light emitting diode OLED, which thereby displays images (e.g., with a predetermined luminance). However, in the organic light emitting display device, uniform images (e.g., images with the predetermined luminance) might not be displayed properly due to variations in the threshold voltages of the second transistors M2'.

When the threshold voltages of second transistors M2' in pixels 4 differ from one another, the respective pixels 4 generate light with different luminances in response to the same data signal. Therefore, it is difficult to display images with uniform luminance.

SUMMARY

Aspects of embodiments of the present invention, provide a pixel capable of displaying images with substantially uniform luminance and an organic light emitting display using the same.

Additionally, further aspects of embodiments of the present invention, provide a pixel and an organic light emitting display device using the same, in which an image with uniform luminance can be displayed regardless of the variation in the threshold voltage of a drive transistor. Further, it is possible to control a period in which the threshold voltage of the drive transistor is compensated for, and accordingly, an image with uniform luminance can be displayed regardless of frame frequencies (e.g., 120 Hz or higher). Furthermore, since all pixels are concurrently changed into an emission or non-emission state, control lines for controlling emission or non-emission can be commonly coupled to all the pixels. Accordingly, aspects of embodiments of the present invention simplify a circuit.

According to an embodiment of the present invention, there is provided an organic light emitting display device driven in a frame divided into a reset period, a compensation period and an emission period. The organic light emitting display device includes: a plurality of pixels coupled to scan lines and data lines; a first control line commonly coupled to the plurality of pixels; a second control line commonly coupled to the plurality of pixels; a control line driver configured to respectively supply first and second control signals to the first and second control lines; a scan driver configured to supply a scan signal concurrently to the scan lines during a first time period in the reset and compensation periods; and a data driver coupled to the data lines, the data driver configured to supply a reset voltage to the data lines during the first time period in the reset and compensation periods.

The scan driver may be further configured to sequentially supply the scan signal to the scan lines during a second time period in the compensation period.

The data driver may be further configured to supply data signals to the data lines in synchronization with the scan signal during the second time period in the compensation period.

The control line driver may be configured to supply the second control signal to the second control line during the reset and emission periods, and to supply the first control signal to the first control line during the compensation period.

The organic light emitting display device may further include a first power source configured to supply power having a voltage level that changes during the frame, to the pixels.

The first power source may be configured to supply the power having a low-level during the reset period, and to supply the power having a high-level during the compensation and emission periods.

The low-level power may be a voltage at which the organic light emitting diode is turned off.

According to one embodiment, each of the pixels may include: an organic light emitting diode including a cathode electrode coupled to a second power source; a first transistor coupled between the first power source and the organic light emitting diode; a second transistor coupled between a corresponding one of the data lines and a gate electrode of the first transistor, the second transistor including a gate electrode coupled to a corresponding one of the scan lines; a fourth transistor coupled between the second transistor and the gate electrode of the first transistor, the fourth transistor including a gate electrode coupled to the second control line; a third transistor coupled between the gate electrode of the first transistor and a reference power source, the third transistor including a gate electrode coupled to the first control line; and a storage capacitor coupled between a common electrode of the fourth and second transistors and an anode electrode of the organic light emitting diode.

The reference power source may be configured to supply a voltage, wherein the reference voltage minus a threshold voltage of the first transistor, is a voltage at which the organic light emitting diode is turned off.

A reference voltage supplied by the reference power source may be higher than the voltage of the low-level power.

The reset voltage may be a voltage at which the first transistor is turned on.

According to an embodiment of the present invention, the organic light emitting display device may further include a third control line commonly coupled to the plurality of pixels, wherein the control line driver is further configured to supply a third control signal to the third control line during the first time period at which the scan signal is concurrently supplied to the scan lines in the reset period.

Each of the plurality of pixels may include: an organic light emitting diode including a cathode electrode coupled to the second power source; a first transistor coupled between the first power source and the organic light emitting diode; a second transistor coupled between a corresponding one of the data lines and a gate electrode of the first transistor, the second transistor including a gate electrode coupled to a corresponding one of the scan lines; a fourth transistor coupled between the second transistor and the gate electrode of the first transistor, the fourth transistor including a gate electrode coupled to the second control line; a third transistor coupled between the gate electrode of the first transistor and the reference power source, the third transistor including a gate electrode coupled to the first control line; a storage capacitor coupled between a common electrode of the fourth and second transistors and an anode electrode of the organic light emitting diode; and a fifth transistor coupled between the anode electrode of the organic light emitting diode and an initialization power source, the fifth transistor for being turned on when the third control signal is supplied to the third control line.

The initialization power source may be configured to supply a lower voltage than the reference voltage.

The initialization power source may be configured to supply a voltage to the first control line when the first control signal is not supplied.

The reset voltage may be a voltage at which the first transistor is turned off.

According to another embodiment of the present invention a pixel may include: an organic light emitting diode including a cathode electrode coupled to a second power source; a first transistor for controlling an amount of current supplied to the organic light emitting diode from a first power source; a second transistor coupled between a data line and a gate electrode of the first transistor, the second transistor including a gate electrode coupled to a scan line; a fourth transistor coupled between the second transistor and the gate electrode of the first transistor, the fourth transistor including a gate electrode coupled to a second control line; a third transistor coupled between the gate electrode of the first transistor and a reference power source, the third transistor including a gate electrode coupled to a first control line; and a storage capacitor coupled between a common electrode of the fourth and second transistors and an anode electrode of the organic light emitting diode.

The third and fourth transistors may be alternately turned on and off.

The pixel may further include a fifth transistor coupled between the anode electrode of the organic light emitting diode and an initialization power source, the fifth transistor including a gate electrode coupled to a third control line.

The fifth transistor may be turned on before the reference power source is supplied to the gate electrode of the first transistor.

The reference power source may be configured to supply a higher voltage than the initialization power source.

The initialization power source may be configured to supply a voltage to the first control line when the first control signal is not supplied.

BRIEF DESCRIPTION OF THE DRAWINGS

The accompanying drawings, together with the specification, illustrate exemplary embodiments of the present invention, and, together with the description, serve to explain the principles of the embodiments of the present invention, in which.

DETAILED DESCRIPTION

Figure 1:
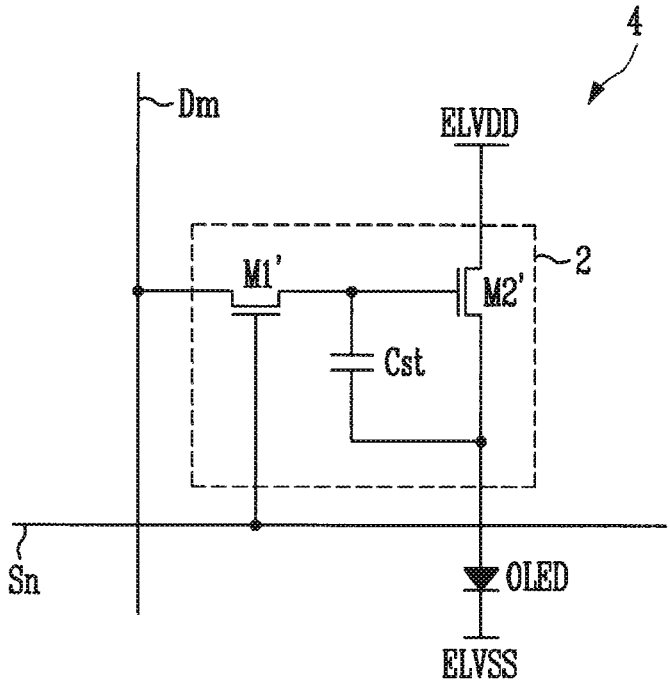
FIG. 1 (Related Art)
FIG. 1 is a circuit diagram of a related art pixel.

Hereinafter, certain exemplary embodiments according to the present invention will be described with reference to the accompanying drawings. When a first element is described as being coupled to a second element, the first element may be directly coupled to the second element or may be indirectly coupled to the second element via a third element. Further, some of the elements that are not essential to a complete understanding of the described embodiments are omitted for clarity. Also, like reference numerals refer to like elements throughout.

Figure 2:
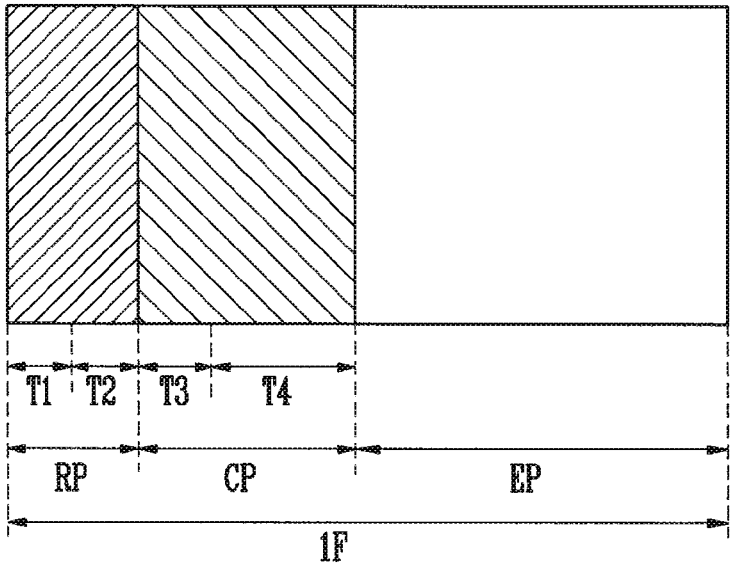
FIG. 2 is a diagram illustrating one frame according to an embodiment of the present invention.

FIG. 2 is a diagram illustrating one frame according to an embodiment of the present invention.

Referring to FIG. 2, according to an embodiment of the present invention, a one frame 1F is divided into a reset period RP, a compensation period CP and an emission period EP.

In the reset period RP, an initialization power source is supplied to anode electrodes of organic light emitting diodes included in all pixels. The pixels are set to be in a non-emission state during the reset period RP. The reset period RP is divided into a first time T1 and a second time T2 according to the waveform supplied during the reset period RP, which is described below.

The compensation period CP is divided into a third time T3 in which the threshold voltage of a drive transistor is compensated for in each of the pixels and a fourth time T4 in which a data signal is supplied to each of the pixels. The pixels are set to be in a non-emission state during the compensation period CP.

During the emission period EP, the pixels generate light (e.g., a light with a predetermined luminance.) Here, the threshold voltage of the drive transistor in each of the pixels is compensated for during the compensation period CP. Hence, an image with substantially uniform luminance can be displayed regardless of variation in the threshold voltage of the drive transistor during the emission period EP.

During the third time T3 of the compensation period CP, the threshold voltage of the drive transistor can be sufficiently compensated for. In this case, although a display device may be driven at a frame frequency of 120 Hz or higher, the threshold voltage of the drive transistor can be stably compensated for. Accordingly, an image with substantially uniform luminance can be displayed. Additionally, all the pixels are concurrently (e.g. simultaneously) changed into an emission or non-emission state, and hence, control lines for controlling emission or non-emission can be commonly coupled to all the pixels. Accordingly, a circuit can be simplified.

Figure 3:
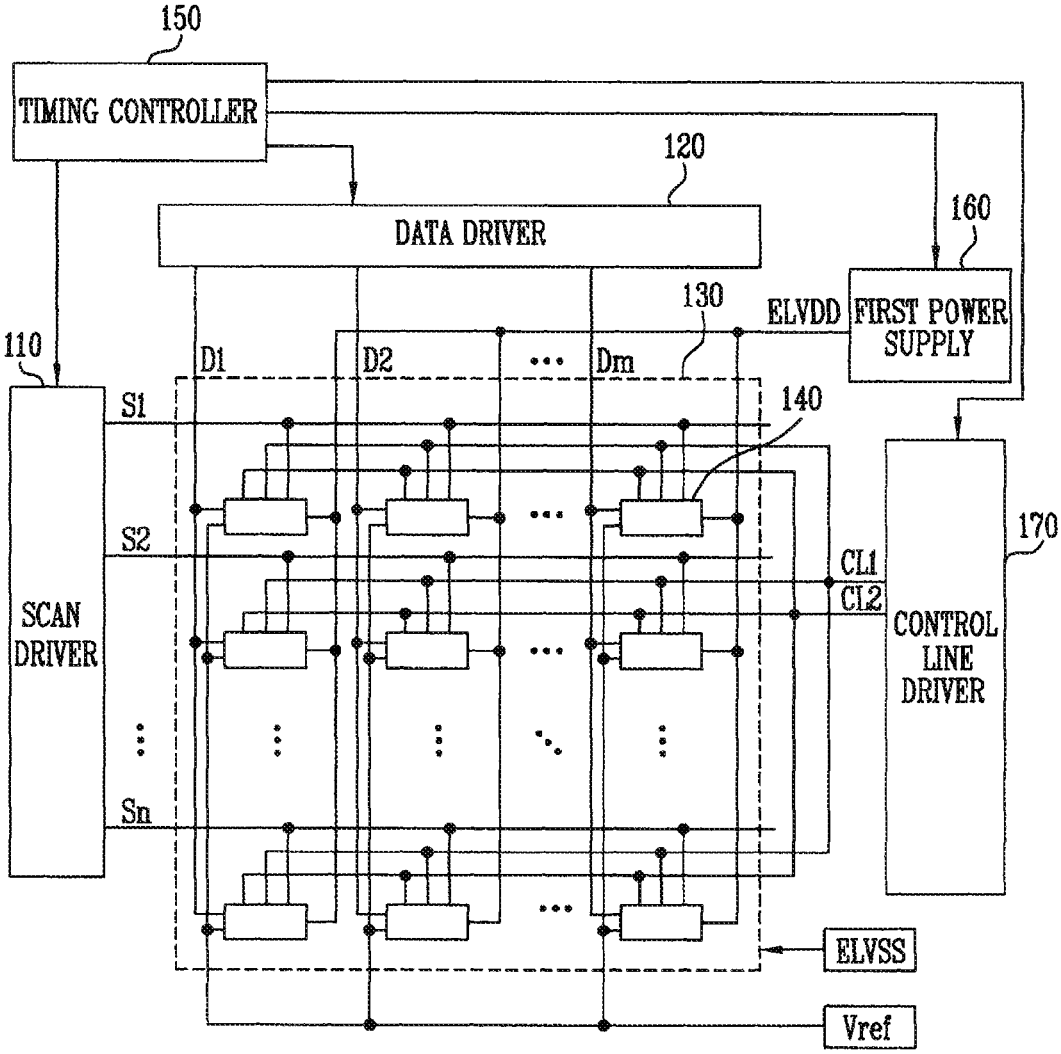
FIG. 3 is a block diagram of an organic light emitting display device according to an embodiment of the present invention.

FIG. 3 is a block diagram of an organic light emitting display device according to an embodiment of the present invention.

Referring to FIG. 3, the organic light emitting display device includes a plurality of pixels 140 coupled to scan lines S1 to Sn and data lines D1 to Dm; a scan driver 110 for driving the scan lines S1 to Sn; a data driver 120 for driving the data lines D1 to Dm; a first power supply 160 for generating a first power source ELVDD; a control line driver 170 for driving a first control line CL1 and a second control line CL2; and a timing controller 150 for controlling the scan driver 110, the data driver 120, the control line driver 170 and the first power supply 160.

The scan driver 110 concurrently (e.g. simultaneously) supplies a scan signal to the scan lines S1 to Sn during the second and third times T2 and T3. The scan driver 110 sequentially supplies a scan signal to the scan lines S1 to Sn during the fourth time T4.

The data driver 120 supplies a reset voltage to the data lines D1 to Dm during the reset period RP and the third time T3 in the compensation period CP. During the fourth time T4, the data driver 120 supplies data signals to the data lines D1 to Dm in synchronization with the scan signals.

The first power supply 160 supplies a low-level first power source ELVDD_L (or initialization power source) during the reset period RP and supplies a high-level first power source ELVDD_H during the compensation and emission periods CP and EP. Here, the low-level first power source ELVDD_L has a lower voltage than a reference power source Vref. The high-level first power source ELVDD-H has a higher voltage than the reference power source Vref.

The control line driver 170 supplies a second control signal to the second control line CL2 during the reset and emission periods RP and EP. The control line driver 170 supplies a first control signal to the first control line CL1 during the compensation period CP. The first and second control signals are supplied at a voltage at which transistors coupled to the first and second control lines CL1 and CL2 can be turned on.

The timing controller 150 controls the scan driver 110, the data driver 120, the first power source supply 160 and the control line driver 170 in response to synchronization signals supplied from an external source.

A display unit 130 is coupled to a first power source ELVDD, a second power source ELVSS, and a reference power source Vref which is supplied from an external source. The display unit 130 supplies the power from the power sources to each of the plurality of pixels 140. In each of the plurality of pixels 140, an anode electrode of an organic light emitting diode OLED is supplied with the voltage from the the low-level first power source ELVDD_L during the reset period RP. Each of the plurality of pixels 140 allows the threshold voltage of a drive transistor and the voltage corresponding to a data signal to be charged therein during the compensation period CP, and generates light corresponding to the charged voltage during the emission period EP.

Figure 4:
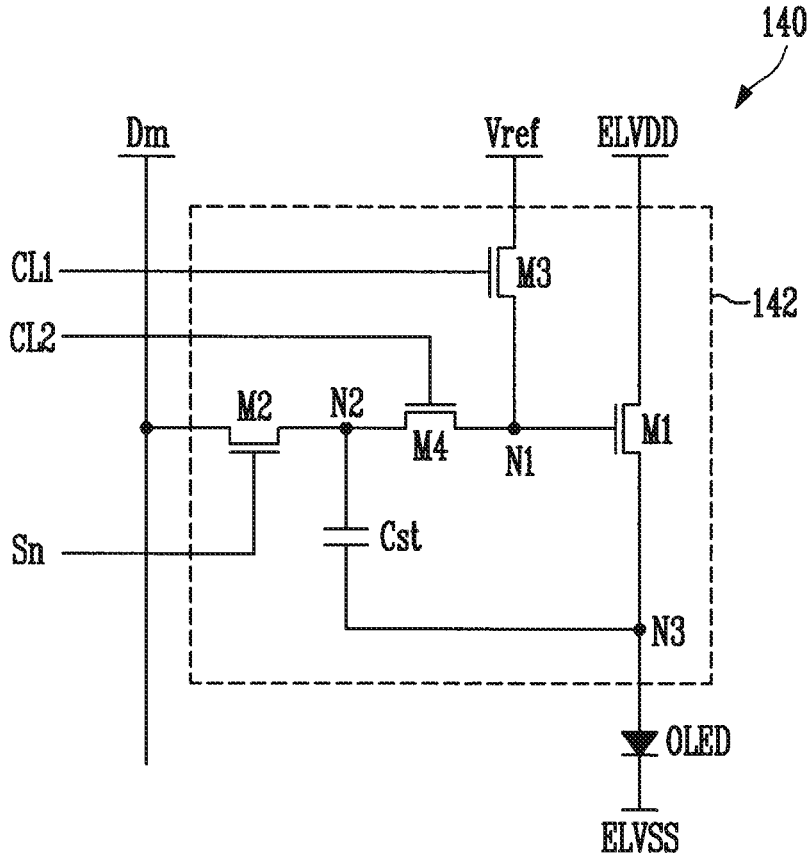
FIG. 4 is a circuit diagram illustrating an embodiment of a pixel illustrated in FIG. 3.

FIG. 4 is a circuit diagram illustrating an embodiment of the pixel illustrated in FIG. 3. For convenience of illustration, a pixel 140 coupled to an n-th scan line Sn and an m-th data line Dm is shown in FIG. 4.

Referring to FIG. 4, the pixel 140 of this embodiment includes an organic light emitting diode OLED, and a pixel circuit 142 coupled to the data line Dm, the scan line Sn, a first control line CL1, and a second control line CL2 for controlling the organic light emitting diode OLED.

An anode electrode of the organic light emitting diode OLED is coupled to the pixel circuit 142, and a cathode electrode of the organic light emitting diode OLED is coupled to a second power source ELVSS. The organic light emitting diode OLED generates light (e.g., a light with a predetermined luminance) corresponding to a current supplied from the pixel circuit 142.

The pixel circuit 142 initializes the anode electrode of the organic light emitting diode OLED with the voltage from the low-level first power source ELVDD_L during the reset period RP, and allows a data signal and a voltage corresponding to the threshold voltage of a drive transistor to be charged in the pixel 140 during the compensation period CP. Then, the pixel circuit 142 supplies current corresponding to the charged voltage to the organic light emitting during the emission period EP. To this end, the pixel circuit 142 includes first to fourth transistors M1 to M4 and a storage capacitor Cst. In one embodiment, the first to fourth transistors M1 to M4 are NMOS transistors.

A gate electrode of the first transistor M1 (e.g., a drive transistor) is coupled to a first node N1, and a first electrode of the first transistor M1 is coupled to a first power source ELVDD. A second electrode of the first transistor M1 is coupled to the anode electrode (i.e., a third node N3) of the organic light emitting diode OLED. The first transistor M1 controls the amount of current supplied to the organic light emitting diode OLED corresponding to the voltage applied to the first node N1.

A gate electrode of the second transistor M2 is coupled to the scan line Sn, and a first electrode of the second transistor M2 is coupled to the data line Dm. A second electrode of the second transistor M2 is coupled to a second node N2. When a scan signal is supplied to the scan line Sn, the second transistor M2 is turned on so that the data line Dm and the second node N2 are electrically coupled to each other.

A gate electrode of the third transistor M3 is coupled to the first control line CL1, and a first electrode of the third transistor M3 is coupled to a reference power source Vref. A second electrode of the third transistor M3 is coupled to the first node N1 (i.e., the gate electrode of the first transistor M1). When a first control signal is supplied to the first control line CL1, the third transistor M3 is turned on. In other cases, the third transistor M3 is turned off.

A gate electrode of the fourth transistor M4 is coupled to the second control line CL2, and a second electrode of the fourth transistor M4 is coupled to the first node N1. A first electrode of the fourth transistor M4 is coupled to the second node N2. When a second control signal is supplied to the second control line CL2, the fourth transistor M4 is turned on. In other cases, the fourth transistor M4 is turned off. That is, the fourth transistor M4 is turned on during the reset period RP and the emission period EP, and is turned off during the compensation period CP. In this case, the third and fourth transistors M3 and M4 are alternately turned on and turned off.

The storage capacitor Cst is coupled between the second and third node N2 and N3. A voltage corresponding to the threshold voltage of the first transistor M1 and a data signal is charged into the storage capacitor Cst.

FIGS. 5A to 5E are views illustrating a driving method of the pixel illustrated in FIG. 4. FIGS. 9A to 9E are timing diagrams which correspond to the diagrams illustrated in FIGS. 5A to 5E, respectively. For instance, the figure illustrated, in FIG. 5A, should be understood in conjunction with the timing diagram of FIG. 9A, and more particularly to the indicated time (e.g., T1 for FIG. 9). Similarly, 5B-5E should be understood in conjunction with FIGS. 9B-9E, respectively, and particularly, the indicated time periods of the respective FIGS. (e.g., T2 for FIG. 9B; T3 for FIG. 9C; T4 for FIG. 9D; and EP for FIG. 9E).

Figure 5A:
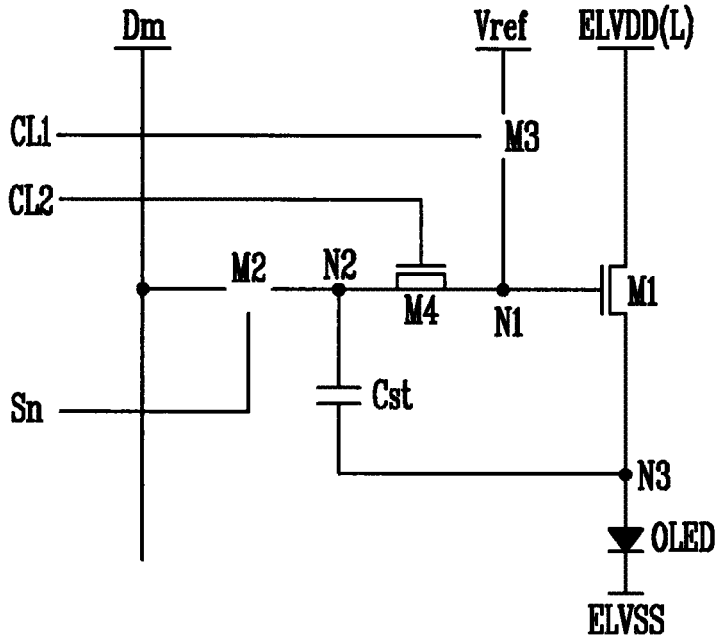
FIGS. 5A to 5E are diagrams illustrating a driving method of the pixel illustrated in FIG. 4.
Figure 9A:
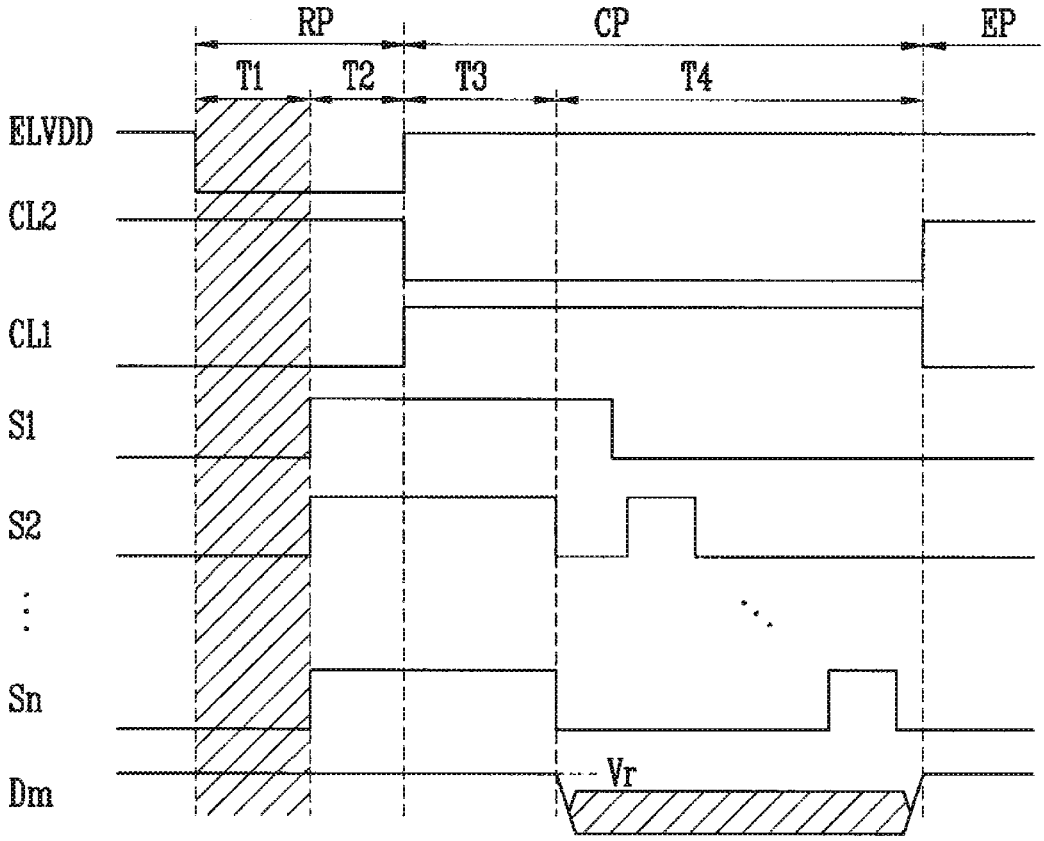
FIGS. 9A to 9E are timing diagrams corresponding to the diagrams illustrated in FIGS. 5A to 5E, respectively.

The operation process of the pixel will be described in detail. As illustrated in FIGS. 5A and 9A, a low-level power source ELVDD_L is first supplied during a reset period RP. Then, a second control signal is supplied to the second control line CL2 during a first time T1 in the reset period RP. When the second control signal is supplied to the second control line CL2, the fourth transistor M4 is turned on. When the fourth transistor M4 is turned on, the first and second nodes N1 and N2 are electrically coupled to each other.

Figure 5B:
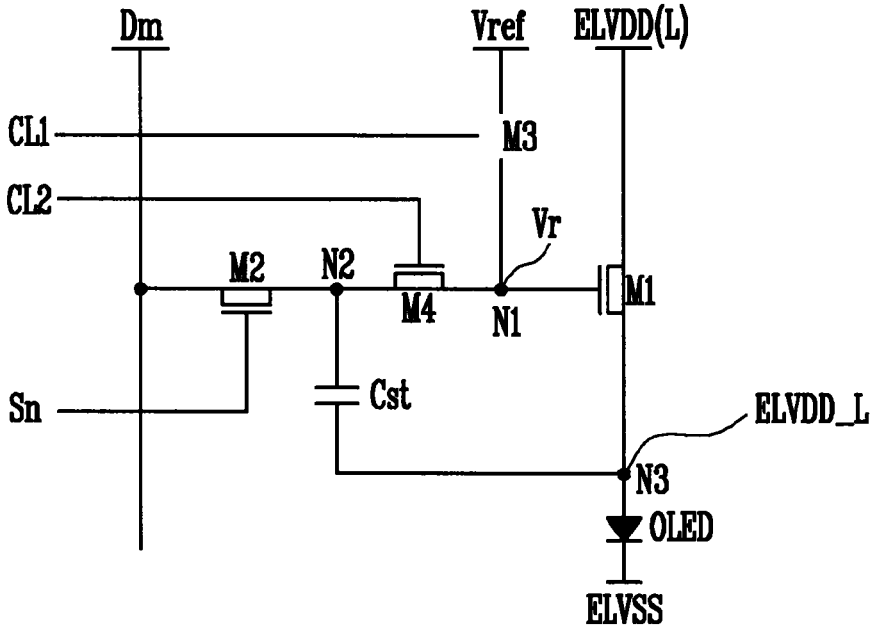
Figure 9B:
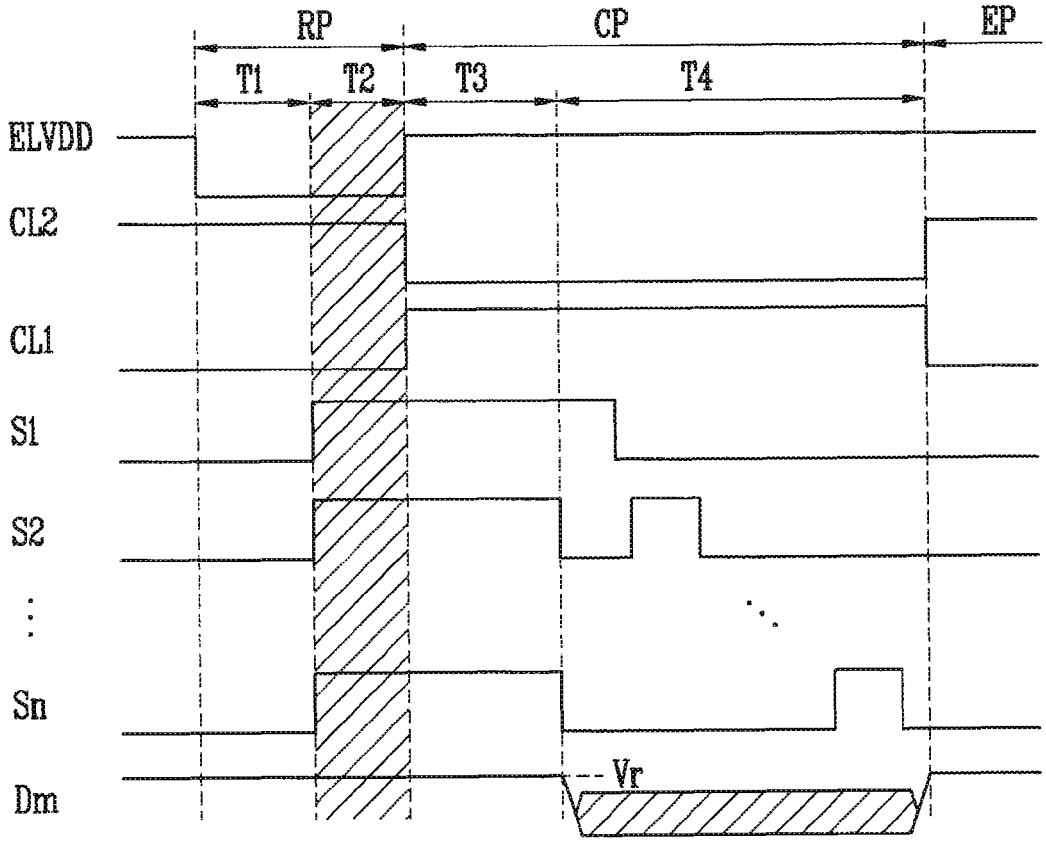

Subsequently, as illustrated in FIGS. 5B and 9B, a scan signal is concurrently (e.g. simultaneously) supplied to all the scan lines S1 to Sn during a second time T2 in the reset period RP. At this time, a reset voltage Vr is supplied to the data line Dm. The reset voltage Vr is a voltage at which the first transistor M1, included in the pixel 140, can be turned on.

When the scan signal is supplied to the scan lines S1 to Sn, the second transistor M2 is turned on. When the second transistor M2 is turned on, the reset voltage Vr is supplied from the data line Dm to the first node N1 via the second node N2 and the fourth transistor M4 (as the second control signal continues to be provided to the second control line CL2). At this time, the first transistor M1 is turned on, and accordingly, the voltage from the low-level first power source ELVDD_L is supplied to the third node N3. Here, the low-level first power source ELVDD_L is a voltage at which the organic light emitting diode OLED can be turned off, and accordingly, unnecessary light is not generated from the organic light emitting diode OLED.

For convenience of illustration, the reset period RP has been divided into the first and second times T1 and T2. However, embodiments of the present invention are not limited thereto. In practice, the voltage of the first power source ELVDD may be lowered to a low level. In this case, the reset period RP refers to a second time T2 (e.g., the first time T1 is omitted).

Figure 5C:
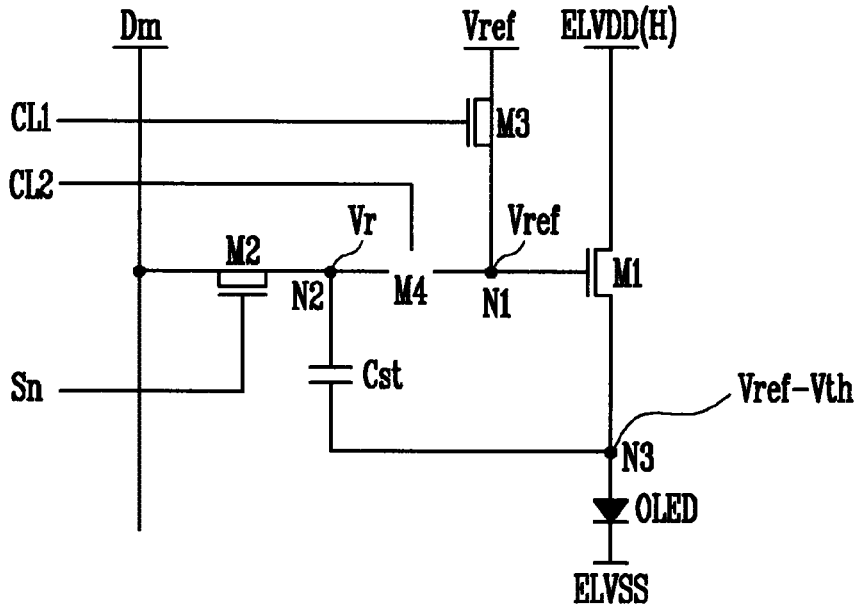
Figure 9C:
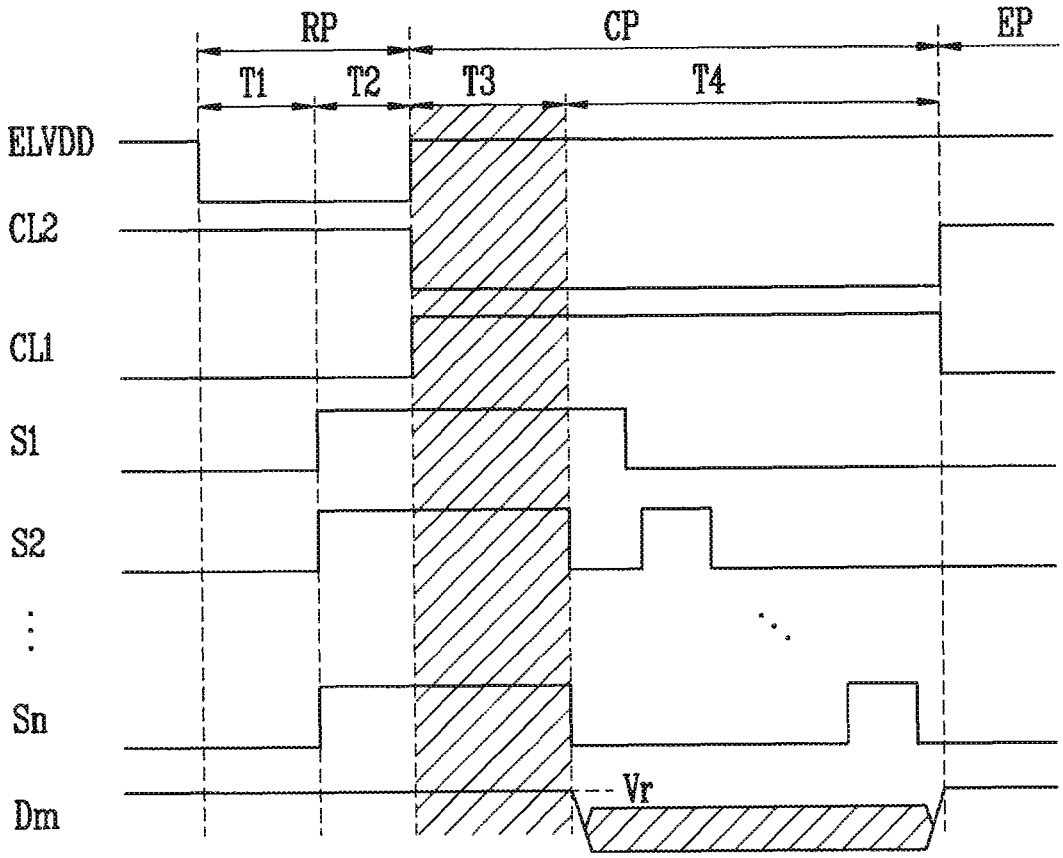

As illustrated in FIGS. 5C and 9C, during a compensation period CP, a first control signal is supplied to the first control line CL1, and the supply of the second control signal to the second control line CL2 is stopped. Then, the scan signal is supplied to the scan lines S1 to Sn during a third time T3 in the compensation period CP. A high-level first power source ELVDD_H is also supplied during the compensation period CP.

When the supply of the second control signal to the second control line CL2 is stopped, the fourth transistor M4 is turned off, and accordingly, the first and second nodes N1 and N2 are electrically isolated from each other. When the scan signal is supplied to the scan lines S1 to Sn, the second transistor M2 maintains a turned-on state, and accordingly, the second node N2 maintains the reset voltage Vr.

When the first control signal is supplied to the first control line CL1, the third transistor M3 is turned on. When the third transistor M3 is turned on, the voltage of a reference power source Vref is applied to the first node N1. When the voltage of the reference power source Vref is applied to the first node N1, the voltage at the third node N3 is gradually increased up to the voltage obtained by subtracting the threshold voltage of the first transistor M1 from the voltage of the reference power source Vref.

More specifically, the voltage from the low-level first power source ELVDD_L, supplied to the third node N3 during the reset period RP, has a voltage level lower than the voltage of the reference power source Vref minus the threshold voltage of the first transistor M1. Therefore, when the voltage of the reference power source Vref is applied to the first node N1, the voltage at the third node N3 is increased to the voltage obtained by subtracting the threshold voltage of the first transistor M1 from the voltage of the reference power source Vref. At this time, a voltage corresponding to a difference in voltage between the second and third nodes N2 and N3 is charged in the storage capacitor Cst. That is, a voltage corresponding to the threshold voltage of the first transistor M1 is charged in the storage capacitor Cst.

In an embodiment of the present invention, a sufficient time is assigned to the third time T3 so that the voltage at the third node N3 in the pixel 140 can be stably increased to the voltage obtained by subtracting the threshold voltage of the first transistor M1 from the voltage of the reference power source Vref. The voltage of the reference power source Vref is set so that the organic light emitting diode OLED can be turned off (e.g., changed to a non-emission state) when the voltage obtained by subtracting the threshold voltage of the first transistor M1 from the voltage of the reference power source Vref is provided to the third node N3.

Figure 5D:
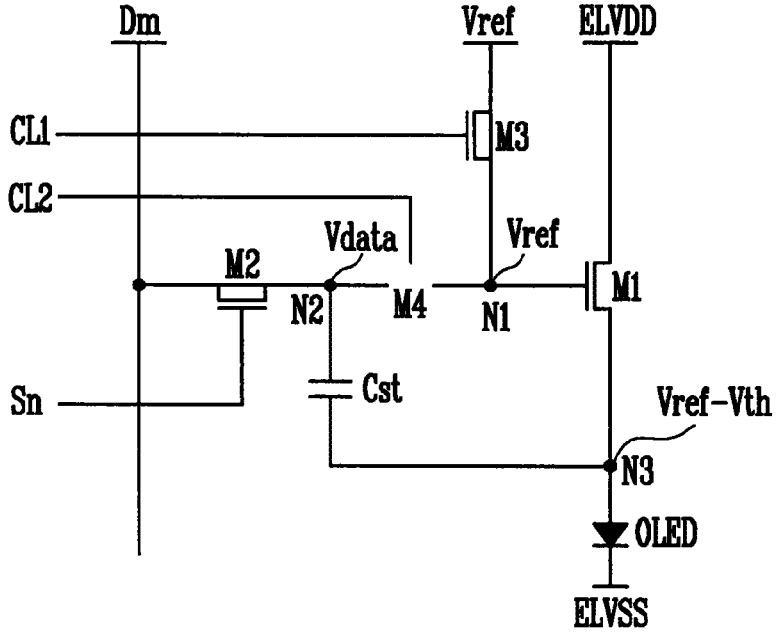
Figure 9D:
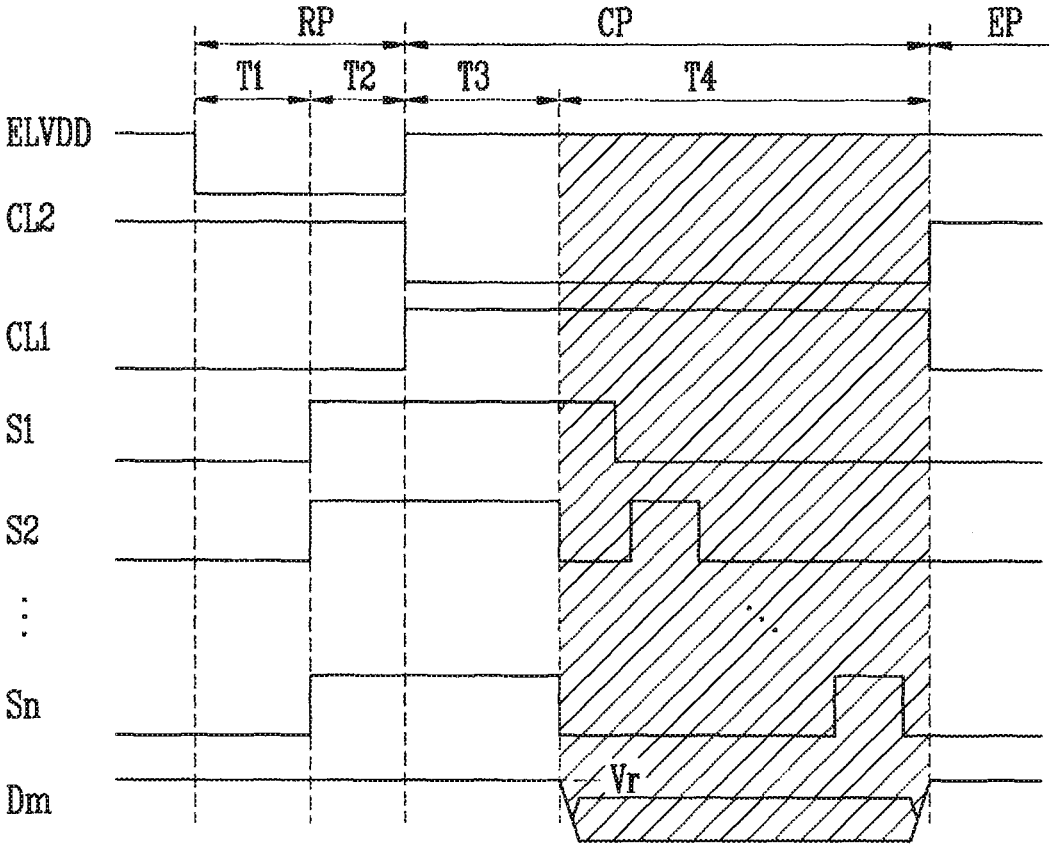

As illustrated in FIGS. 5D and 9D, the scan signals are sequentially supplied to the scan lines S1 to Sn during a fourth time T4 in the compensation period CP. In this case, the second transistors M2, included in the respective pixels 140, are sequentially turned on by the horizontal line. When the second transistor M2 is turned on, a data signal supplied from the data line Dm is supplied to the second node N2. At this time, a voltage Vdata of the data signal is provided to the second node N2.

Figure 5E:
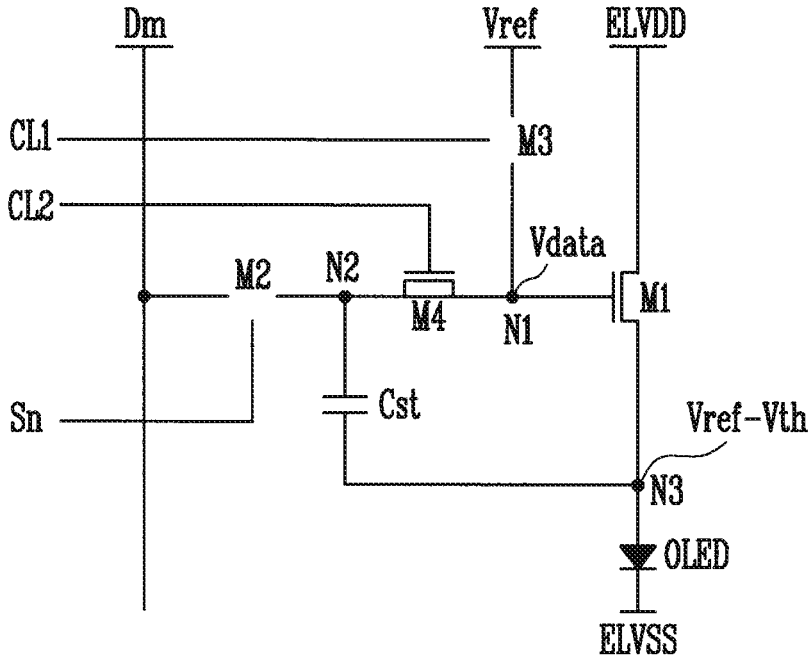
Figure 9E:
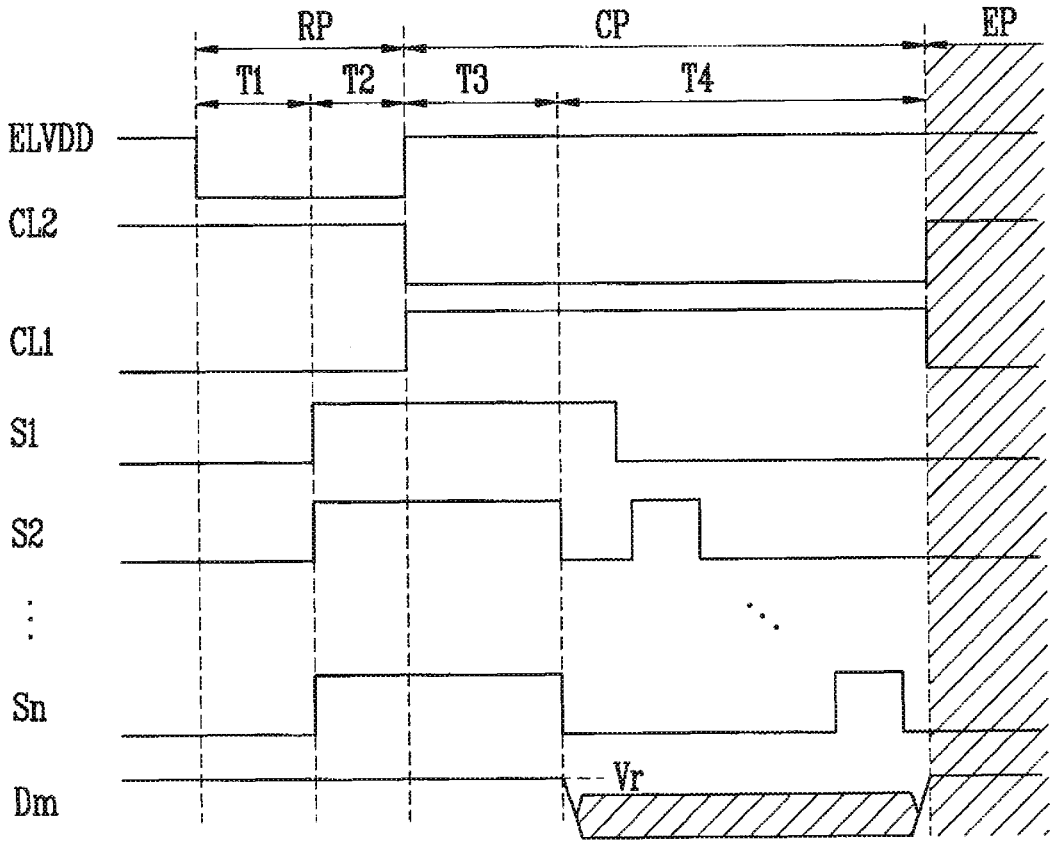

As illustrated in FIGS. 5E and 9E, the second control signal is supplied to the second control line CL2 in an emission period EP. When the second control signal is supplied to the second control line CL2, the fourth transistor M4 is turned on. When the fourth transistor M4 is turned on, the second and first nodes N2 and N1 are electrically coupled to each other. In this case, the voltage at the first node N1 is the voltage Vdata of the data signal.

More specifically, the voltage at the second node N2 is the voltage Vdata of the data signal before the emission period EP, and the voltage at the first node N1 is supplied by the reference power source Vref. Here, the voltage of the data signal provided to the second node N2 is a voltage stored in the storage capacitor Cst, and the reference power source Vref provided to the first node N1 is a voltage supplied from a voltage source. Thus, during the emission period EP, the first and second node N1 and N2 are electrically coupled to each other, and the voltage at the first node N1 is the voltage Vdata of the data signal when the third transistor M3 is turned off.

Ideally, the voltage at the first node N1 is equal to the voltage Vdata of the data signal. However, in practice, the voltage at the first node N1 may not be exactly the same as the voltage Vdata of the data signal due at least in part to the voltage (e.g., the voltage of the reference power source Vref) charged in a parasitic capacitor of the first transistor M1 before the emission period EP. However, the capacitance of the storage capacitor Cst is relatively higher such that the capacitance of the parasitic capacitor can be ignored.

When the voltage at the first node N1 equals the voltage Vdata of the data signal, the voltage between the gate and source electrodes of the first transistor M1 is as illustrated in Equation 1 below.

$$Vgs(M1)=Vdata-(Vref-Vth) \quad \text{Equation 1}$$

The current that flows into the organic light emitting diode OLED is determined by the voltage Vgs between the gate and source electrodes of the first transistor M1 as illustrated in Equation 2 below.

$$Ioled=\beta(Vgs(M1)-Vth(M1))^2=\beta\{(Vdata-Vref+Vth)-Vth(M1)\}^2=(Vdata-Vref)^2 \quad \text{Equation 2}$$

Referring to Equation 2, the current that flows into the organic light emitting diode OLED is determined by the difference between the voltage Vdata of the data signal and the voltage of the reference power source Vref. Here, the reference voltage Vref supplies a fixed voltage, and therefore, the current that flows into the organic light emitting diode OLED is determined by the voltage Vdata of the data signal. As illustrated in Equation 2, an image with substantially uniform luminance can be displayed regardless of the variation in the threshold voltage of the first transistor M1.

Figure 6:
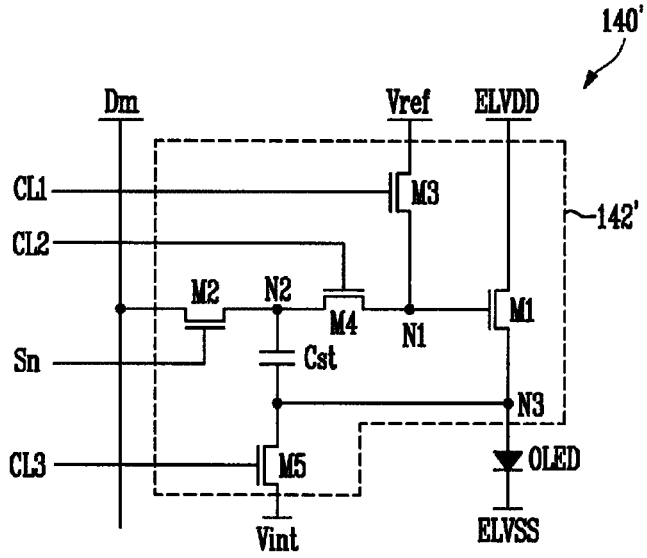
FIG. 6 is a circuit diagram illustrating another embodiment of the pixel illustrated in FIG. 3.

FIG. 6 is a circuit diagram illustrating another embodiment of the pixel illustrated in FIG. 3. In FIG. 6, components similar to those of FIG. 4 are designated by like reference numerals, and their detailed descriptions will be omitted. For convenience of illustration, a pixel coupled to an n-th scan line Sn and an m-th data line Dm is illustrated in FIG. 6.

Referring to FIG. 6, the pixel 140' includes an organic light emitting diode OLED and a pixel circuit 142'.

The pixel circuit 142' further includes a fifth transistor M5 coupled between a third node N3 and an initialization power source Vint. When a third control signal is supplied to a third control line CL3, the fifth transistor M5 is turned on. Here, the third control line CL3 is commonly coupled to each of the plurality of pixels 140, and receives the third control signal supplied from the control line driver 170 during a second time T2 in a reset period RP.

When the third control signal is supplied to the third control line CL3, the fifth transistor M5 is turned on to supply the voltage of the initialization power source Vint to the third node N3. In this case, the voltage of a first power source ELVDD is maintained as a high-level voltage during one frame period. The initialization power source Vint has a lower voltage than the voltage obtained by subtracting the threshold voltage of a first transistor M1 from the voltage of a reference power source Vref. The initialization power source Vint supplies a voltage at which the organic light emitting diode OLED can be turned off.

Figure 7:
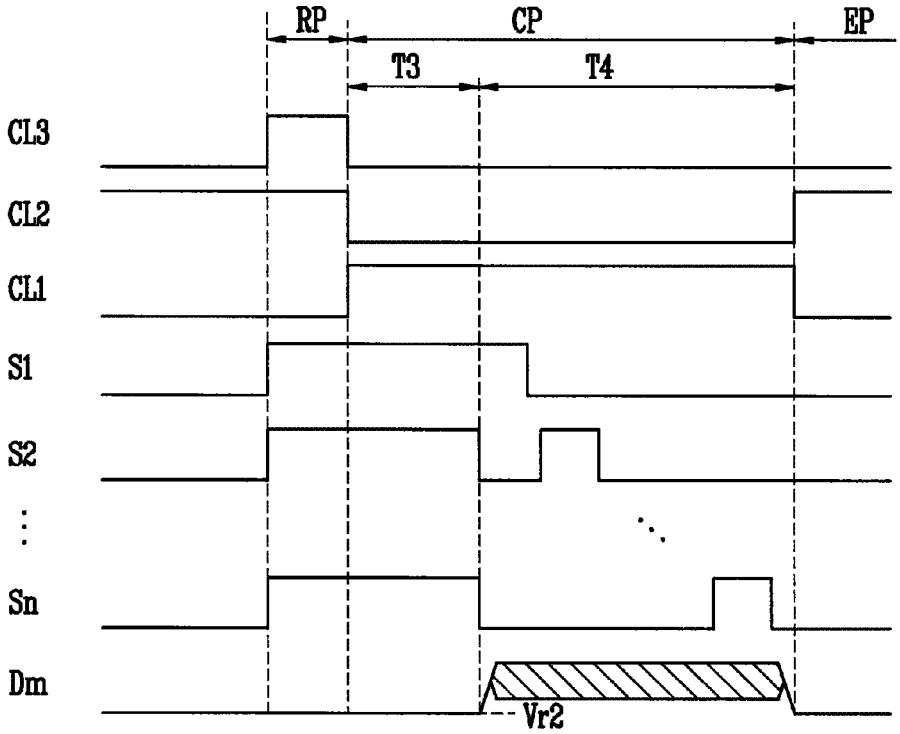
FIG. 7 is a waveform diagram illustrating a driving method of the pixel illustrated in FIG. 6.

FIG. 7 is a waveform diagram illustrating a driving method of the pixel illustrated in FIG. 6.

Referring to FIG. 7, a scan signal is concurrently (e.g. simultaneously) supplied to scan lines S1 to Sn during a reset period RP (e.g., a second period). Then, a second reset voltage Vr2 is supplied to a data line Dm during the reset period RP. The second reset voltage Vr2 is a voltage at which the first transistor M1 included in the pixel 140' can be turned off. During the reset period RP, a third control signal is supplied to a third control line CL3.

When the third control signal is supplied to the third control line CL3, the fifth transistor M5 is turned on, and accordingly, the initialization power source Vint is supplied to the third node N3. When the scan signals are supplied to the scan lines S1 to Sn, a second transistor M2 is turned on. When the second transistor M2 is turned on, a reset voltage Vr is supplied from the data line Dm to a first node N1 via a second node N2. At this time, the first transistor M1 is turned off, and accordingly, a voltage at the third node N3 is a voltage of the initialization power source Vint.

During a compensation period CP, a first control signal is supplied to a first control line CL1. Then, the scan signals are supplied to the scan lines S1 to Sn during a third time T3 in the compensation period CP. When the scan signals are supplied to the scan lines S1 to Sn, the second transistor M2 maintains a turned-on state, and accordingly, the second reset voltage Vr2 is maintained at the second node N2.

When the first control signal is supplied to the first control line CL1, a third transistor M3 is turned on. When the third transistor M3 is turned on, the voltage of the reference voltage Vref is supplied to the first node N1. When the voltage of the reference voltage Vref is supplied to the first node N1, the voltage at the third node N3 is gradually increased up to the voltage obtained by subtracting the threshold voltage of the first transistor M1 from the voltage of the reference power source Vref.

During a fourth time T4 in the compensation period CP, the scan signals are sequentially supplied to the scan lines S1 to Sn. In this case, second transistors M2, included in the respective pixels 140', are sequentially turned on by the scan signals via the scan line. When the second transistor M2 is turned on, a data signal supplied from the data line Dm is supplied to the second node N2. At this time, the voltage Vdata of the data signal is provided to the second node N2.

During an emission period EP, a second control signal is supplied to a second control line CL2. When the second control signal is supplied to the second control line CL2, a fourth transistor M4 is turned on. When the fourth transistor M4 is turned on, the second and first nodes N2 and N1 are electrically coupled to each other. In this case, the voltage at the first node N1 is a voltage Vdata of the data signal.

When the voltage at the first node N1 is the voltage Vdata of the data signal, the voltage between gate and source electrodes of the first transistor M1 is set as illustrated in Equation 1. Thus, a current is supplied to the organic light emitting diode OLED as illustrated in Equation 2.

Figure 8:
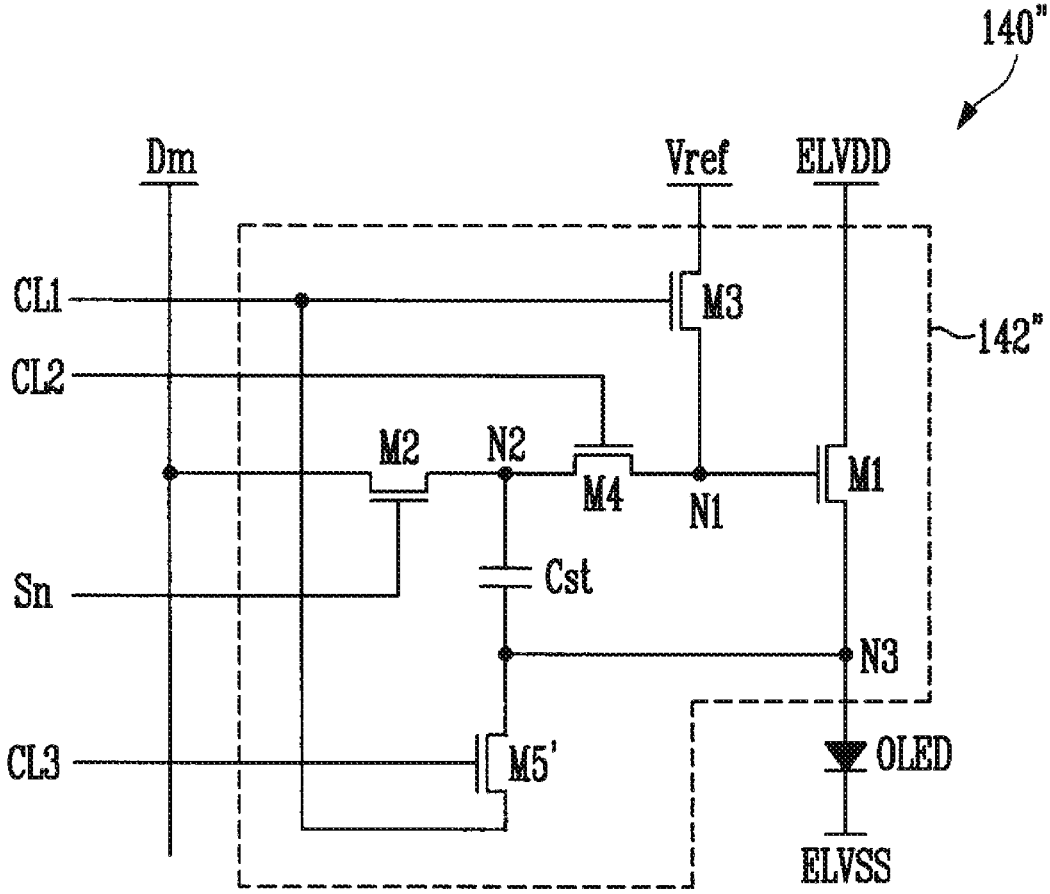
FIG. 8 is a circuit diagram illustrating still another embodiment of the pixel illustrated in FIG. 3.

FIG. 8 is a circuit diagram illustrating still another embodiment of the pixel illustrated in FIG. 3. In FIG. 8, components similar to those of FIG. 6 are designated by like reference numerals, and their detailed descriptions will be omitted.

Referring to FIG. 8, the pixel 140" includes a pixel circuit 142" and an organic light emitting diode OLED.

The pixel circuit 142" includes a fifth transistor M5' coupled between a third node N3 and a first control line CL1. A gate electrode of the fifth transistor M5' is coupled to a third control line CL3. When a third control signal is supplied to the third control line CL3, the fifth transistor M5' is turned on to supply a voltage supplied to the first control line CL1 to the third node N3.

When a first control signal is not supplied, the voltage similar to an initialization power source Vint is provided to the first control line CL1. That is, when the first control signal is not supplied, a lower voltage than the voltage obtained by subtracting the threshold voltage of a first transistor M1 from the voltage of a reference voltage Vref is provided to the first control line CL1. The other operations are similar to those of FIG. 6, and therefore, their detailed descriptions will be omitted.

While embodiments of the present invention have been described in connection with certain exemplary embodiments, it is to be understood that the invention is not limited to the disclosed embodiments, but, on the contrary, is intended to cover various modifications and equivalent arrangements included within the spirit and scope of the appended claims, and their equivalents.

What is claimed is:

1. An organic light emitting display device driven in a frame divided into a reset period, a compensation period and an emission period, comprising:

a plurality of pixels coupled to scan lines and data lines;

a first control line commonly coupled to the plurality of pixels;

a second control line commonly coupled to the plurality of pixels;

a control line driver configured to respectively supply first and second control signals to the first and second control lines, wherein the control line driver is configured to supply first and second control signals at a first level and a second level, respectively, during the compensation period and at the second level and the first level, respectively, during the emission period;

a scan driver configured to supply a scan signal concurrently to the scan lines during a time in the reset and compensation periods; and a data driver configured to supply a reset voltage to the data lines during a first time period in the reset and compensation periods.

2. The organic light emitting display device according to claim 1, wherein the scan driver is further configured to sequentially supply the scan signal to the scan lines during a second time period in the compensation period.

3. The organic light emitting display device according to claim 2, wherein the data driver is further configured to supply data signals to the data lines in synchronization with the scan signal during the second time period in the compensation period.

4. The organic light emitting display device according to claim 1, wherein the control line driver is configured to supply the second control signal to the second control line during the reset and emission periods, and to supply the first control signal to the first control line during the compensation period.

5. The organic light emitting display device according to claim 4, further comprising a first power source configured to supply power having a voltage level that changes during the frame, to the pixels.

6. The organic light emitting display device according to claim 5, wherein the first power source is configured to supply the power having a low-level power during the reset period, and to supply the power having a high-level power during the compensation and emission periods.

7. The organic light emitting display device according to claim 6, wherein the low-level power has a voltage at which an organic light emitting diode is turned off.

8. The organic light emitting display device according to claim 6, wherein each of the pixels comprises:

an organic light emitting diode comprising a cathode electrode coupled to a second power source;

a first transistor coupled between the first power source and the organic light emitting diode;

a second transistor coupled between a corresponding one of the data lines and a gate electrode of the first transistor, the second transistor comprising a gate electrode coupled to a corresponding one of the scan lines;

a fourth transistor coupled between the second transistor and the gate electrode of the first transistor, the fourth transistor comprising a gate electrode coupled to the second control line;

a third transistor coupled between the gate electrode of the first transistor and a reference power source, the third transistor comprising a gate electrode coupled to the first control line; and a storage capacitor coupled between a common electrode of the fourth and second transistors and an anode electrode of the organic light emitting diode.

9. The organic light emitting display device according to claim 8, wherein the reference power source is configured to supply a reference voltage, wherein the reference voltage minus a threshold voltage of the first transistor is a voltage at which the organic light emitting diode is turned off.

10. The organic light emitting display device according to claim 8, wherein a reference voltage supplied by the reference power source is higher voltage than a voltage of the low-level power.

11. The organic light emitting display device according to claim 8, wherein the reset voltage is a voltage at which the first transistor is turned on.

12. The organic light emitting display device according to claim 4, further comprising a third control line commonly coupled to the plurality of pixels, wherein the control line driver is further configured to supply a third control signal to the third control line during the first time period at which the scan signal is concurrently supplied to the scan lines in the reset period.

13. The organic light emitting display device according to claim 12, wherein each of the plurality of pixels comprises:

an organic light emitting diode comprising a cathode electrode coupled to a second power source;

a first transistor coupled between a first power source and the organic light emitting diode;

a second transistor coupled between a corresponding one of the data lines and a gate electrode of the first transistor, the second transistor comprising a gate electrode coupled to a corresponding one of the scan lines;

a fourth transistor coupled between the second transistor and the gate electrode of the first transistor, the fourth transistor comprising a gate electrode coupled to the second control line;

a third transistor coupled between the gate electrode of the first transistor and a reference power source, the third transistor comprising a gate electrode coupled to the first control line;

a storage capacitor coupled between a common electrode of the fourth and second transistors and an anode electrode of the organic light emitting diode; and a fifth transistor coupled between the anode electrode of the organic light emitting diode and an initialization power source, the fifth transistor for being turned on when the third control signal is supplied to the third control line.

14. The organic light emitting display device according to claim 13, wherein the initialization power source is configured to supply a lower voltage than a reference voltage supplied by the reference power source.

15. The organic light emitting display device according to claim 13, wherein the initialization power source is configured to supply a voltage to the first control line when the first control signal is not supplied.

16. The organic light emitting display device according to claim 13, wherein the reset voltage is a voltage at which the first transistor is turned off.

17. A pixel comprising:

an organic light emitting diode comprising a cathode electrode coupled to a second power source;

a first transistor for controlling an amount of current supplied to the organic light emitting diode from a first power source;

a second transistor coupled between a data line and a gate electrode of the first transistor, the second transistor comprising a gate electrode coupled to a scan line;

a fourth transistor coupled between the second transistor and the gate electrode of the first transistor, the fourth transistor comprising a gate electrode coupled to a second control line;

a third transistor coupled between the gate electrode of the first transistor and a reference power source, the third transistor comprising a gate electrode coupled to a first control line; and a storage capacitor coupled between a common electrode of the fourth and second transistors and an anode electrode of the organic light emitting diode, wherein the fourth transistor is configured to electrically couple the gate electrode of the first transistor to the storage capacitor in response to a signal supplied to the second control line.

18. The pixel according to claim 17, wherein the third and fourth transistors are alternately turned on and off.

19. The pixel according to claim 17, further comprising a fifth transistor coupled between the anode electrode of the organic light emitting diode and an initialization power source, the fifth transistor comprising a gate electrode coupled to a third control line.

20. The pixel according to claim 19, wherein the fifth transistor is turned on before the reference power source is supplied to the gate electrode of the first transistor.

21. The pixel according to claim 19, wherein the reference power source is configured to supply a higher voltage than the initialization power source.

22. The pixel according to claim 19, wherein the initialization power source is configured to supply a voltage to the first control line when a first control signal is not supplied.

* * * * *

UNITED STATES PATENT AND TRADEMARK OFFICE

CERTIFICATE OF CORRECTION

PATENT NO. : 8,659,513 B2
APPLICATION NO. : 12/883025
DATED : February 25, 2014
INVENTOR(S) : Sang-Moo Choi et al.

It is certified that error appears in the above-identified patent and that said Letters Patent is hereby corrected as shown below:

On the Title Page

| | |
|---|---|
| (56) References Cited, **FOREIGN** | Delete "KR 2008-026467" |
| **PATENT DOCUMENTS, Ref. 3** | Insert -- JP 2008-026467 -- |

Signed and Sealed this
Fifteenth Day of September, 2015

Michelle K. Lee

Michelle K. Lee
*Director of the United States Patent and Trademark Office*